US007429089B2

(12) United States Patent
Arney

(10) Patent No.: US 7,429,089 B2
(45) Date of Patent: Sep. 30, 2008

(54) DRAWER DIVIDER AUGMENTER

(76) Inventor: Damon S. Arney, P.O. Box 240654, Memphis, TN (US) 38124

( * ) Notice: Subject to any disclaimer, the term of this patent is extended or adjusted under 35 U.S.C. 154(b) by 179 days.

(21) Appl. No.: 11/123,423

(22) Filed: May 6, 2005

(65) Prior Publication Data

US 2006/0250053 A1 Nov. 9, 2006

(51) Int. Cl.
*A47B 63/00* (2006.01)
*A47B 97/02* (2006.01)
*B42F 17/00* (2006.01)

(52) U.S. Cl. ..... 312/183

(58) Field of Classification Search ..... 312/183, 312/184, 190–193, 352, 348.3, 259, 260, 312/261, 330.1; 211/51, 59.4, 50, 184, 71, 211/131; 220/529, 534, 559; 229/115, 9, 229/19, 120.35, 120.37; 53/445, 474, 542, 53/157; 29/428; 248/459
See application file for complete search history.

(56) References Cited

U.S. PATENT DOCUMENTS

| | | | | | |
|---|---|---|---|---|---|
| 686,357 | A | | 11/1901 | Simonson | |
| 889,340 | A | * | 6/1908 | Sherwood | 220/550 |
| 1,038,841 | A | * | 9/1912 | Brown | 312/9.54 |
| 1,370,279 | A | * | 3/1921 | Burzynski | 211/43 |
| 1,615,465 | A | * | 1/1927 | Martin | 229/115 |
| 1,669,139 | A | * | 5/1928 | Martin | 229/125.37 |
| 1,700,317 | A | | 1/1929 | Kamenstein | |
| 2,894,673 | A | * | 7/1959 | Vuillemenot | 229/113 |
| 3,269,392 | A | | 8/1966 | McLain | |
| 3,841,548 | A | * | 10/1974 | Curley | 206/424 |
| 4,102,470 | A | | 7/1978 | Timmons | |
| 4,234,238 | A | | 11/1980 | Figueroa | |
| 4,295,571 | A | | 10/1981 | Meyer | |
| 4,673,091 | A | | 6/1987 | Robinson | |
| 4,726,635 | A | | 2/1988 | Rariden et al. | |
| 4,820,001 | A | | 4/1989 | Paul | |
| 5,060,808 | A | | 10/1991 | Engman | |
| 5,067,780 | A | | 11/1991 | Rickard | |
| 5,358,125 | A | | 10/1994 | Blessing | |
| 5,494,175 | A | | 2/1996 | Higdon et al. | |
| 5,775,522 | A | | 7/1998 | Martin, Sr. | |
| 5,795,040 | A | | 8/1998 | Simmons | |
| 5,806,941 | A | * | 9/1998 | Diederich et al. | 312/183 |
| 5,826,956 | A | * | 10/1998 | Norton | 312/183 |
| 6,272,727 | B1 | | 8/2001 | Fish | |
| 6,279,299 | B1 | | 8/2001 | Lee | |

* cited by examiner

*Primary Examiner*—Janet M Wilkens
*Assistant Examiner*—Timothy M Ayres
(74) *Attorney, Agent, or Firm*—Woodard, Emhardt, Moriarty, McNett & Henry LLP

(57) ABSTRACT

An augmenter to supplement a drawer divider for a file cabinet. The augmenter in one embodiment is a wedge shaped box that augments a drawer divider for a file cabinet to prevent items from sliding behind or under the drawer divider. The wedge shaped box is positioned immediately adjacent to the drawer divider. The long side of the wedge faces outward towards the front of the drawer. Alternatively, other embodiments contemplate other augmenter configurations to prevent items from slipping behind or under the drawer divider.

7 Claims, 5 Drawing Sheets

DRAWER DIVIDER AUGMENTER

TECHNICAL FIELD

This present invention generally relates to devices and methods used to organize drawers of file cabinets, and more particularly, but not exclusively, to a device to augment a drawer divider to prevent items from slipping behind the drawer divider into other sections of the drawer.

BACKGROUND

For many years, file cabinets have been used to organize items. For instance, folders, papers, files, book, binders, and other office equipment have commonly been stored in the drawers of a file cabinet. File cabinet drawers can be opened and closed so as to easily access the items stored therein.

Many times the contents of a drawer in a file cabinet can become very disorganized. In addition, different areas of the drawer may need to be divided. Heretofore, drawer dividers have been used to divide file cabinet drawers. In some forms, the drawer dividers extend from the bottom of the drawer to the top of the drawer and are moveable along with the length of the drawer. These types of dividers are not always used, however, because they are more expensive and are more awkward to use.

Alternatively, a drawer divider that extends from one side of the drawer to the other side of the drawer across the top is used in many file cabinets. These drawer dividers are cheaper and easier to use by moving them across the easily accessible top of the drawer divider. These drawer dividers, however, do not extend completely down to the bottom of the drawer. While less expensive and easier to use, this design does not really prevent items, especially papers or files, from slipping underneath or behind the drawer divider into the other section of the drawer. Also, those items commonly become caught and prevent the drawer divider from sliding within the drawer.

A need therefore exists for a way to prevent items from sliding under a drawer divider that does not extend to the bottom of the drawer. The present invention addresses that need.

SUMMARY OF THE INVENTION

In one aspect of the present invention there is provided a system comprising a filing cabinet having at least one drawer having a bottom surface and two side surfaces; a drawer divider extending across the drawer from one side surface to the other side surface, wherein the drawer divider does not contact the bottom surface of the drawer; and a drawer divider augmenter positioned adjacent the drawer divider and extending upward from the bottom surface of the drawer to prevent items located in the drawer from sliding under the drawer divider.

Another aspect of the invention provides a blank having a top surface and bottom surface and side surfaces, wherein the blank defines three portions that are foldable; said first portion having a trapezoidal shape, the second portion having a rectangular shape, the third portion also having a rectangular shape, wherein the first portion includes at least two notched triangular portions that are foldable, wherein the third portion has at least one tab defining a notch therein, wherein assembly of the blank creates a wedge-shaped box.

A further aspect of the invention provides a method of preventing items from slipping behind a file cabinet drawer divider by providing in a drawer having at least two sides, a bottom, and a drawer divider, wherein the drawer divider extends across the sides without touching the drawer bottom, an augmenter adjacent the drawer divider and extending downward to the bottom surface of the drawer to prevent items located in the drawer from sliding under the drawer divider.

BRIEF DESCRIPTION OF THE DRAWINGS

FIG. 3 illustrates the augmenter of FIG. 2 opened up and disassembled into the blank that it is assembled from.

DETAILED DESCRIPTION OF THE SELECTED EMBODIMENTS

For the purposes of promoting an understanding of the principles of the invention, reference will now be made to preferred embodiments and specific language will be used to describe the same. It will nevertheless be understood that no limitation of the scope of the invention is thereby intended, such alterations, modifications, and further applications of the principles of the present invention as illustrated being contemplated as would normally occur to one skilled in the art to which the invention relates.

One embodiment of the present invention is an augmenter device for augmenting drawer dividers used in a drawer of a file cabinet. Some types of drawer dividers in file cabinets do not completely extend to the bottom of the drawer. This design allows papers or other items to slide underneath the divider. The augmenter is a wedge shaped device in some embodiments that rests against the drawer divider. The incline portion of the wedge faces outward into the portion of the drawer that contains items. The augmenter thereby prevents items from slipping behind the drawer divider. The augmenter may be free-standing and may easily be moved from one drawer to the next. In some embodiments, the augmenter is formed from a blank. The blank is composed of material such as cardboard that contains various cuts and creases that allow it to be folded and assembled into the wedge shaped augmenter.

Figure 1:
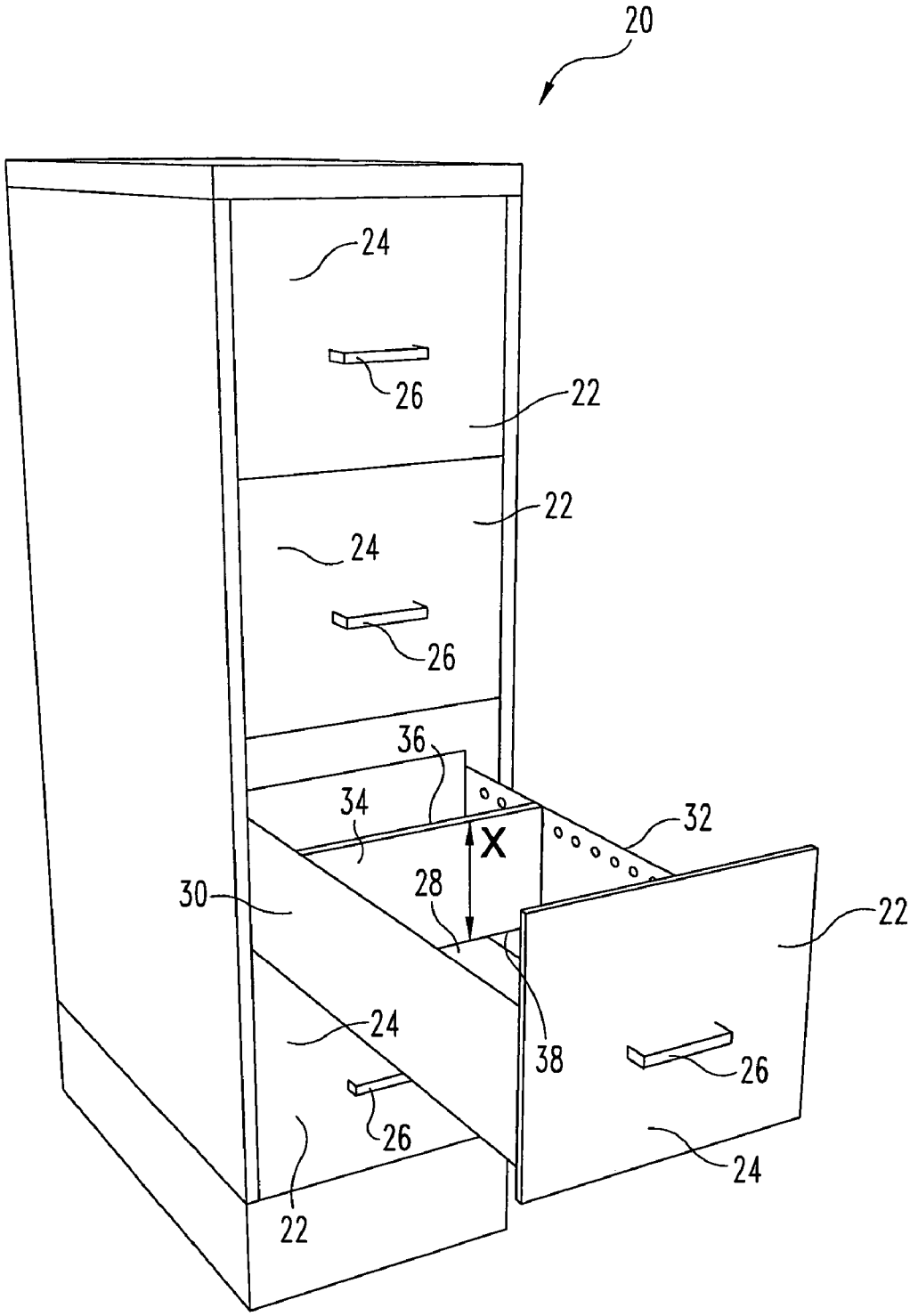
Fig. 1 (PRIOR ART)
FIG. 1 illustrates a file cabinet with an open drawer having a prior art drawer divider.

Referring now to FIG. 1, a prior art file cabinet 20 is illustrated. The file cabinet 20 includes four drawers 22 arranged in a vertical stack. Each of the drawers 22 has a front surface 24 that shields the contents of the drawers 22 from the area outside the file cabinet 20. In addition, the front surface 24 of the drawers 22 includes a handle 26. The handle 26 allows a person to grab the drawer 22 and open it to reveal the contents of the drawer 22.

In the file cabinet 20 illustrated in FIG. 1, the second drawer 22 from the bottom is pulled open. This drawer 22 has a bottom surface 28, a first side surface 30 and a second side surface 32 to define the drawer 22. The drawer 22 also includes a drawer divider 34 that can move along the length of the drawer 22. As FIG. 1 illustrates, the drawer divider 34 extends from generally the top of the first side surface 30 to generally the top of the second side surface 32. More importantly, the drawer divider 34 does not contact the bottom surface 28 of the drawer 22. Because the drawer divider 34 does not contact the bottom surface 28 of the drawer 22, items that are placed in the drawer 22 can slide behind or under the drawer divider 34. The top edge 36 of the drawer divider 34 runs along close to the top edge of the first side surface 30 and second side surface 39 of the drawer 22, hen extends down to a bottom edge 38 that is raised above bottom surface 28 of the drawer 22. In different embodiments, the bottom edge 38 of the drawer divider 34 can range from almost touching bottom surface 28 of the drawer 22 to being well above bottom surface 28.

Figure 2:
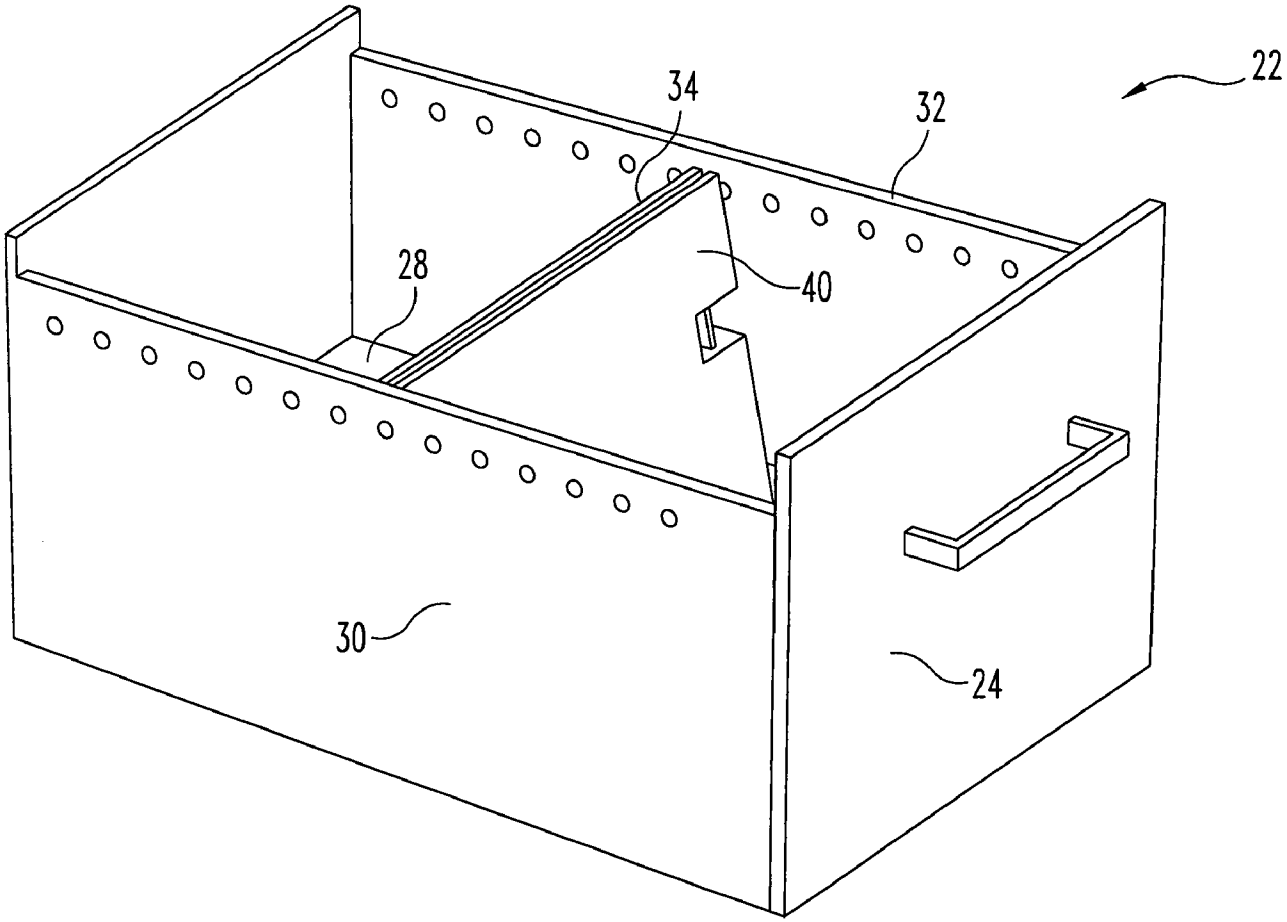
FIG. 2 illustrates a perspective view of one embodiment of an augmenter used in combination with the drawer divider of FIG. 1.

Referring now to FIG. 2, an augmenter 40 is shown positioned adjacent the drawer divider 34 of the drawer 22 that was illustrated in FIG. 1. Augmenter 40 in this embodiment is a wedge shaped device having the longest edge of the augmenter 40 facing towards the front surface 24 of the drawer 22. This augmenter 40 preferably extends from the bottom of the file drawer floor upward at least as high as the bottom of the drawer divider to insure that items between the front surface 24 of the drawer 22 and the augmenter 40 stay within that area and do not slide behind or under the drawer divider 34.

While the augmenter 40 in FIG. 2 is illustrated to be a wedge shaped box, it is contemplated that other types of augmenters can be used in alternative embodiments. For example, a rectangular shaped augmenter is used in other embodiments. Similarly, a wedge shaped augmenter 40 where both sides of the augmenter 40 are at an incline coming up from the bottom surface 28 is also contemplated. The augmenter may be freestanding, as illustrated in FIG. 2.

In addition, augmenters 40 that do not extend completely across from the first side surface 30 to second side surface 32 are contemplated for use in other embodiments. In some embodiments the drawer divider augmenter extends at least half way across the width of the drawer, while in other embodiments the drawer divider augmenter extends at least three quarters of the way across the width of the drawer. In the embodiments most preferred to date, and as illustrated in the drawings, the drawer divider augmenter extends substantially all the way across the width of the drawer.

In the most preferred embodiments the augmenter has a depth of four inches or less so that the augmenter does not use excessive drawer space. Most preferably, the augmenter has a depth of about three inches or less. The depth of the augmenter is defined as the distance the augmenter extends from the drawer divider when the augmenter is positioned adjacent the drawer divider so that the augmenter contacts the drawer divider.

Figure 3:
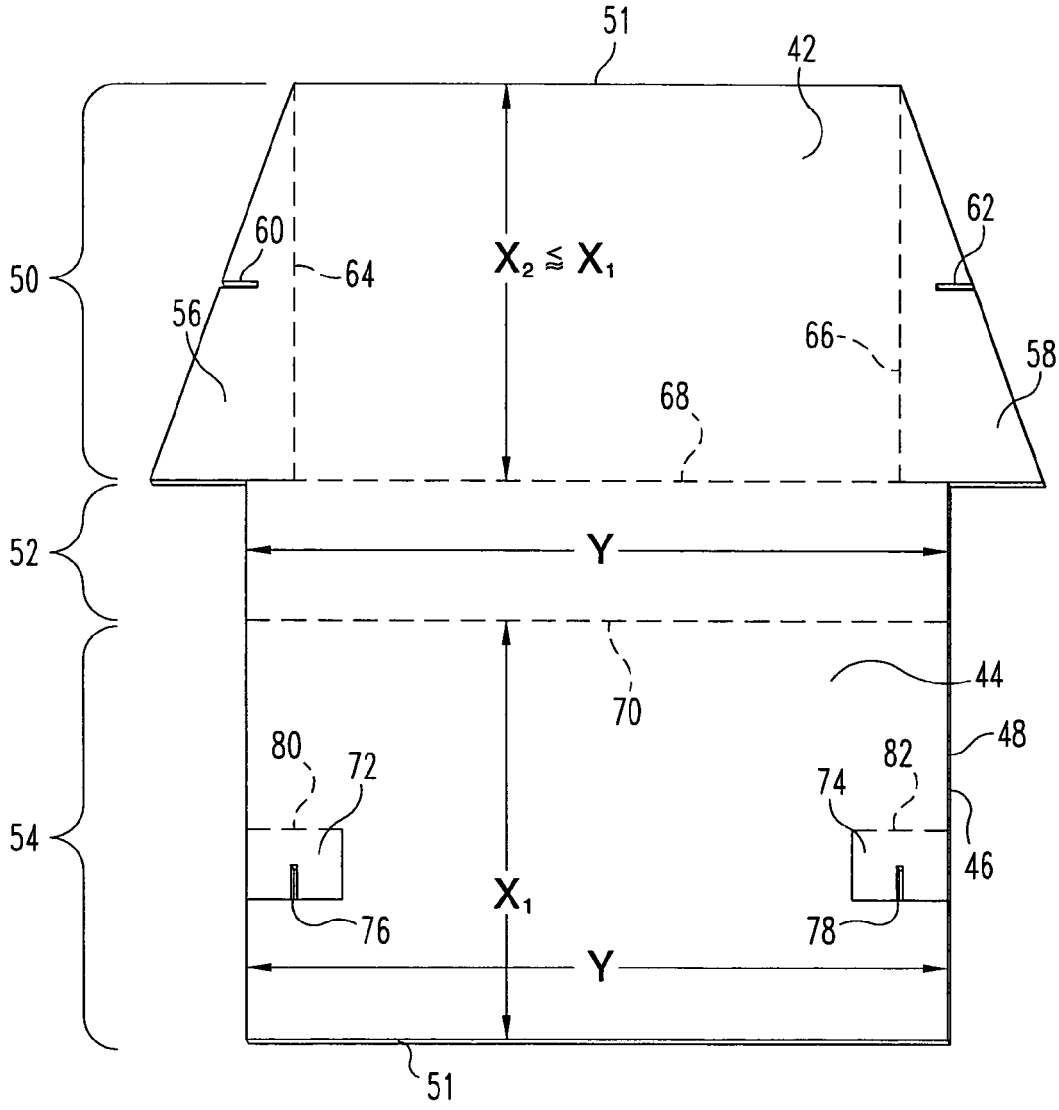

FIG. 3 illustrates the augmenter 40 of FIG. 2 extended out into a foldable blank 42. The foldable blank 42 has a top surface 44 and a bottom surface 46 and side edges 48. Generally, the edges 48 are quite thin as the blank 42 is usually formed from a cardboard sheet. Alternate embodiments, however, contemplate forming the blank 42 from other types of materials such as foam, plastic, metal, and other materials readily apparent to those skilled in the art, in which case side edges 48 may be quite thick and may comprise a separate surface.

The blank 42 includes a first portion 50, a second portion 52 and a third portion 54. The width of the second portion 52 and the third portion 54 is denoted as Y. The height of the third portion 54 (X1) may be slightly larger than the height of the first portion 50 (X2) to thereby cause the ends 51 of the first portion 50 and third portion 52 to meet when folded around the second portion 52. In addition, FIG. 3 illustrates that the width of the second portion 52 and the third portion 54 may be identical to insure that the incline face of the augmenter 40 fully extends across the width of the augmenter 40.

Referring now to the first portion 50, the first portion 50 may have a first triangular portion 56 and a second triangular portion 58 that includes a first notch 60 and a second notch 62 respectively. These triangular portions help define the shape of the first portion 50 to be trapezoidal. These triangular portions 56 and 58 may be foldable along a first crease 64 and a second crease 66. Folding these triangular portions 56, 58 along these creases 64, 66 provides an inclined support for the third portion 54 during assembly.

The second portion 52 may be defined by a first crease 68 and a second crease 70. These creases are the main creases upon which the first portion 50 and the third portion 54 fold around. The second portion 52 is thus rectangularly shaped and becomes the bottom surface of the augmenter 40 that rests upon the bottom surface 28 of the drawer when the augmenter 40 is positioned into place. As indicated above, second portion may have a depth "D" of less than four inches, and preferably no more than three inches, to minimize the space used by the augmenter in the drawer.

The third portion 54 may include a first tab 72 and a second tab 74 that may have a first notch 76 and a second notch 78 respectively. As FIG. 3 illustrates, these tabs 72 and 74 may fold toward the first portion 50 enabling contact with the notches 60, 62 of the first triangular portion 56 and the second triangular portion 58 of the first portion 50 when the first portion 50 and the third portion 54 are folded around the second portion 52. These tabs 72 and 74 preferably fold at the first crease 80 and the second crease 82 in order to combine the notches 60, 62, 76 and 78 to interlock with the triangular portions 56 and 58 of the first portion 50. In other, non-illustrated embodiments tabs 72 and 74 do not include notches 76 and 78, and simply fit in notches 60 and 62 of triangular sidewalls 56 and 58. As may be appreciated by persons skilled in the art, other combinations of tabs and/or notches may additionally or alternatively be used to assist in assembling the augmenter 40 into a wedge shaped box.

In one embodiment the augmenter is sized such that first portion 50 has a width of about 19 inches along its bottom edge, and a height $X_2$ of about 8.5 inches along creases 64 and 66. Notches 60 and 82 extend about 0.75 inches inward from the side edge. Second portion 52 has a width Y of about 15 inches, and a length of about three inches. Third portion 54 has a width Y of about 15 inches, and a height $X_1$ of about 9 inches. Tabs 72 and 74 are about two inches wide (along creases 80 and 82) and about 1.5 inches deep, and include notches 76 and 78 that extend about 0.75 inches into the tabs.

Figure 4:
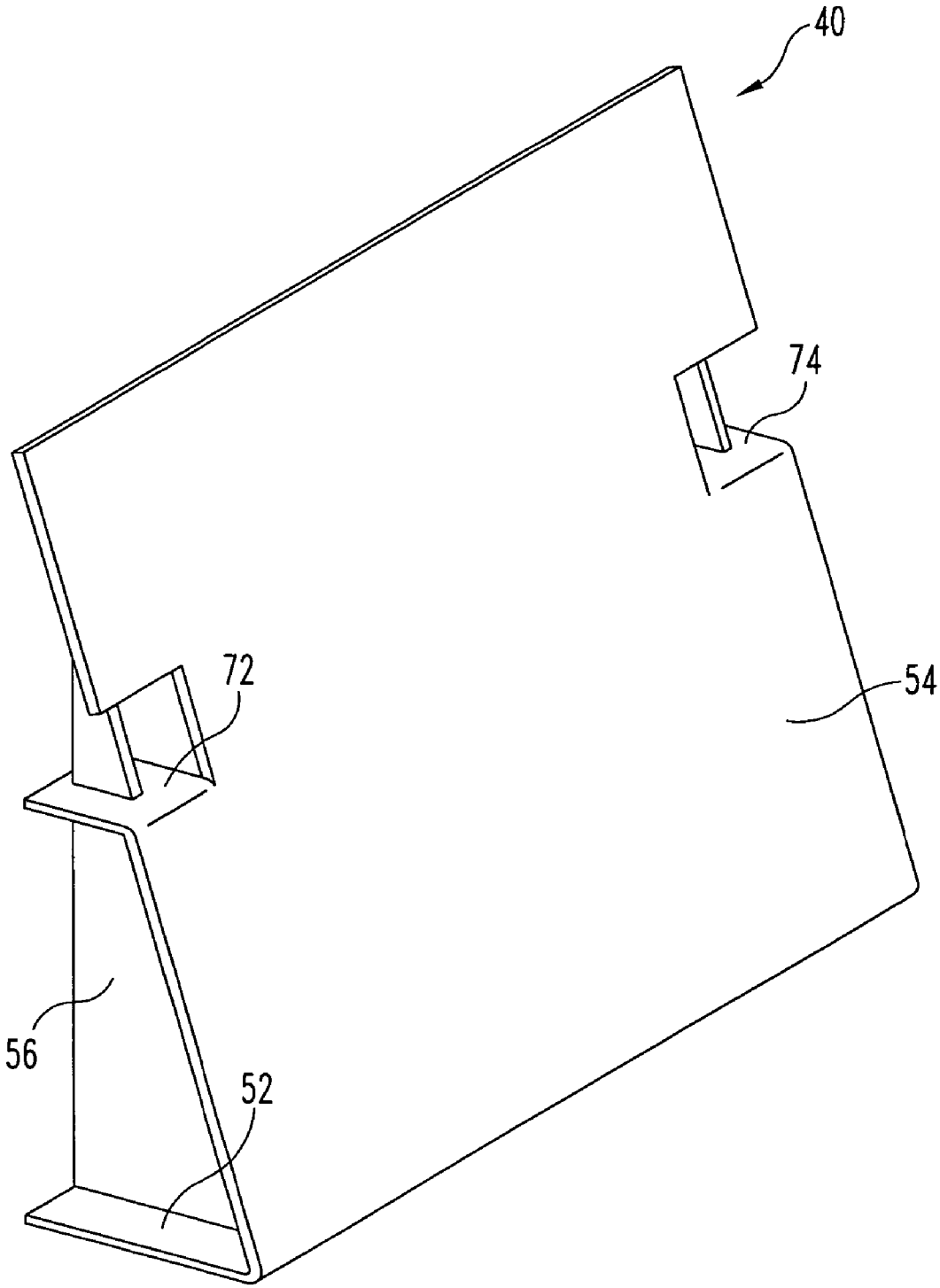
FIG. 4 illustrates a perspective view of one embodiment of an augmenter.

Referring now to FIG. 4, a perspective view of augmenter 40 is illustrated. As the illustration shows, the notches 76 and 78 of the tabs 72 and 74 fit into the notches 60 and 62 of the first and second triangular sidewall portions 56, 58. In addition, the second portion 52 becomes the bottom surface of the wedge shaped box that will rest on the bottom surface 28 of the drawer 22. In addition, the third portion 54 becomes the long surface that prevents items inside the drawer 22 from sliding behind or under the drawer divider 34.

Figure 5:
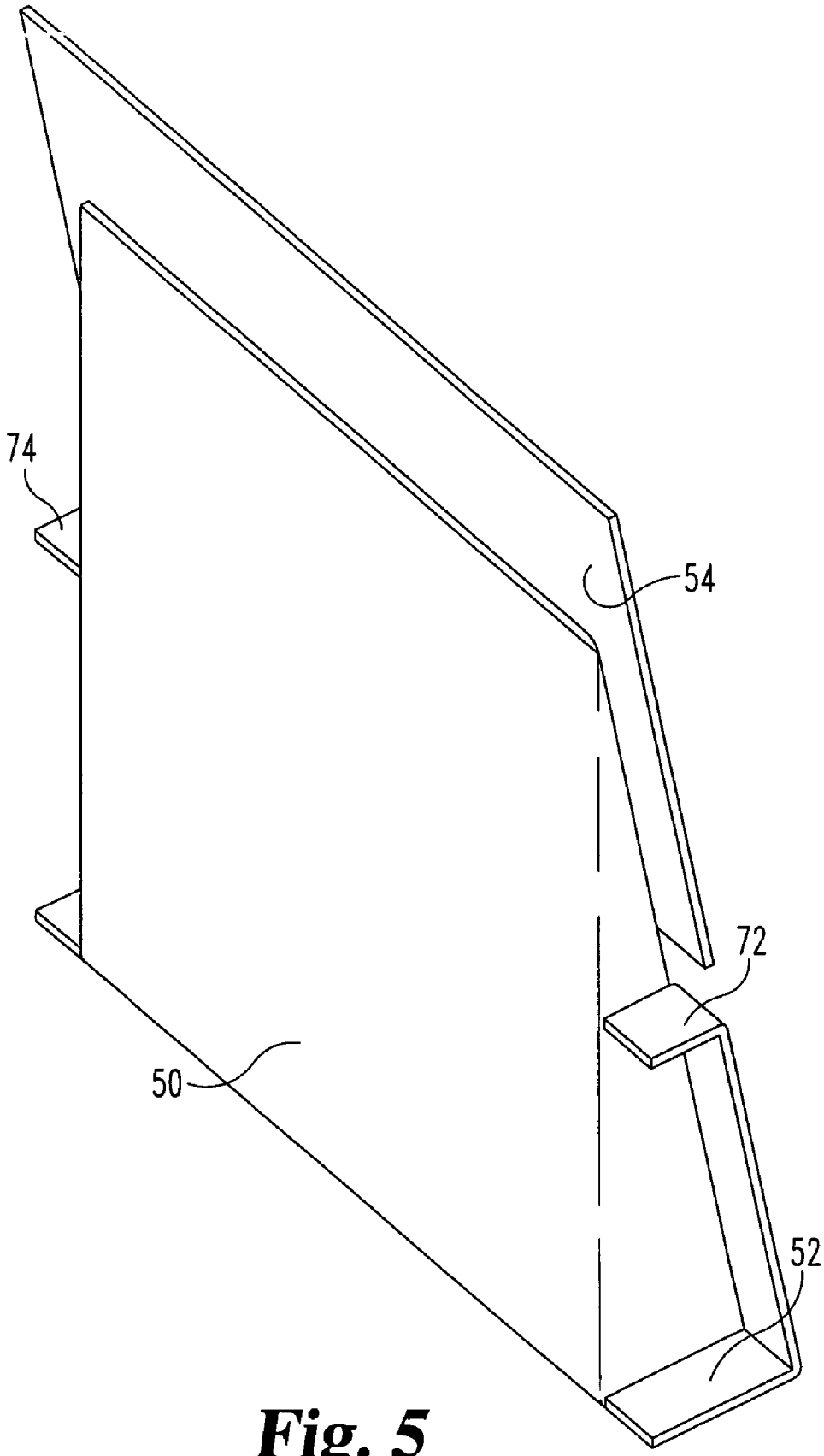
FIG. 5 illustrates a perspective rear view of another embodiment of an augmenter.

Referring now to FIG. 5, an alternative embodiment is illustrated. This embodiment shows in augmenter 40 like the one illustrated in FIG. 4 except from a rear perspective view. The difference between the embodiment illustrated in FIG. 4 and the one of FIG. 5 is that the augmenter has a third portion 54 with a height that is sizably larger than the height of the first portion 50. The advantage of the design of FIG. 5 is that this additional height provided by the third portion becomes a "riser" that sticks above the file and items below. Moreover, this "riser" can carry advertisements or other labeling.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for preventing items from slipping under a drawer divider, said method comprising: providing a drawer having a first side, a second side, a bottom, and a drawer divider, wherein said drawer divider extends across said drawer from said first side to said second side without extending to the drawer bottom, and positioning a freestanding drawer divider augmenter adjacent said drawer divider such that the drawer divider augmenter contacts the drawer divider and extends upward from the bottom surface of the drawer in a manner effective to prevent items located in the drawer from sliding under the drawer divider; wherein said drawer divider augmenter is formed from a foldable blank, with the blank including a first portion having a trapezoidal shape, a second portion having a rectangular shape, and a third portion having a rectangular shape, wherein said third portion has at least two foldable tabs therein, with each foldable tab including a notch; and wherein said first portion includes at least two notched triangular portions that are folded to engage one of said notches in said third portion tab.

2. The method of claim 1, wherein said augmenter extends upward from the drawer bottom at least as high as the bottom of the drawer divider.

3. The method of claim 1, wherein said drawer divider is movable along the length of said drawer.

4. The method of claim 1 wherein said blank is made of cardboard.

5. The method of claim 1 wherein said blank is made of metal.

6. The method of claim 1 wherein said third portion has a height greater than the height of said first portion to form a riser.

7. The method of claim 6 wherein said riser includes an advertisement.

* * * * *